US007028678B2

(12) United States Patent
Betz et al.

(10) Patent No.: US 7,028,678 B2
(45) Date of Patent: Apr. 18, 2006

(54) INTERNAL COMBUSTION ENGINE

(76) Inventors: Thomas Betz, Schwabstrasse 33 b, 70197, Stuttgart (DE); Frank Duvinage, Weiherstrasse 45/1, 73230, Kirchheim (DE); Rüdiger Pfaff, Im Wolfbusch 46, 70499, Stuttgart (DE); Heiko Sass, Rosenstrasse 35, 71732, Tamm (DE)

( * ) Notice: Subject to any disclaimer, the term of this patent is extended or adjusted under 35 U.S.C. 154(b) by 0 days.

(21) Appl. No.: 10/911,906

(22) Filed: Aug. 5, 2004

(65) Prior Publication Data

US 2005/0034701 A1 Feb. 17, 2005

Related U.S. Application Data

(63) Continuation-in-part of application No. PCT/EP02/14453, filed on Dec. 18, 2002.

(30) Foreign Application Priority Data

Feb. 5, 2002 (DE) ..... 102 04 482

(51) Int. Cl.

| | |
|---|---|
| ***F02B 33/00*** | (2006.01) |
| ***F02B 33/44*** | (2006.01) |
| ***F02B 77/00*** | (2006.01) |
| ***F02D 15/00*** | (2006.01) |
| ***F02D 17/02*** | (2006.01) |
| ***F02D 21/08*** | (2006.01) |
| ***F02D 23/00*** | (2006.01) |

(52) U.S. Cl. ..... 123/562; 60/612; 123/481; 123/198 DB; 123/198 F; 123/DIG. 7

(58) Field of Classification Search ..... 123/563, 123/198 F, 481, 198 DB, DIG. 7, 562; 60/612
See application file for complete search history.

(56) References Cited

U.S. PATENT DOCUMENTS

| | | | | |
|---|---|---|---|---|
| 3,902,472 | A * | 9/1975 | Baugelin | 123/198 F |
| 3,941,113 | A * | 3/1976 | Baguelin | 123/198 F |
| 4,231,338 | A | 11/1980 | Sugasawa et al. | 123/681 |
| 4,313,406 | A | 2/1982 | Iizuka et al. | 123/198 F |
| 4,364,345 | A | 12/1982 | Tsutumi et al. | 123/198 F |
| 4,411,230 | A * | 10/1983 | Lee | 123/198 F |
| 4,455,984 | A * | 6/1984 | Merlini et al. | 123/198 F |
| 4,473,044 | A * | 9/1984 | Hudson | 123/198 F |
| 4,860,716 | A * | 8/1989 | Deutschmann | 123/198 F |
| 5,826,563 | A * | 10/1998 | Patel et al. | 123/198 F |
| 6,158,218 | A * | 12/2000 | Herold et al. | 123/198 F |
| 6,318,310 | B1 * | 11/2001 | Clarke | 123/70 R |
| 6,553,977 | B1 * | 4/2003 | Schmitz | 123/70 R |
| 6,640,543 | B1 * | 11/2003 | Seal | 123/198 F |
| 6,786,190 | B1 * | 9/2004 | Wu et al. | 123/198 F |

FOREIGN PATENT DOCUMENTS

| | | | |
|---|---|---|---|
| DE | 196 11 363 | | 6/1997 |
| DE | 198 12 090 | | 9/1999 |
| JP | 56 118532 | | 9/1981 |
| JP | 57 1860363 | | 11/1982 |
| JP | 59200037 | A * | 11/1984 |
| JP | 61192822 | A * | 8/1986 |
| JP | 03275949 | A * | 12/1991 |

* cited by examiner

*Primary Examiner*—Sheldon J Richter
(74) *Attorney, Agent, or Firm*—Klaus J. Bach

(57) ABSTRACT

In an internal combustion engine having a plurality of cylinders, some of which can be deactivated during operation of the engine, the cylinders which can be deactivated during operation are configured specifically for high load engine operation and have a lower compression ratio $\epsilon$ than the rest of the cylinders, which are configured specifically for low load engine operation.

7 Claims, 1 Drawing Sheet

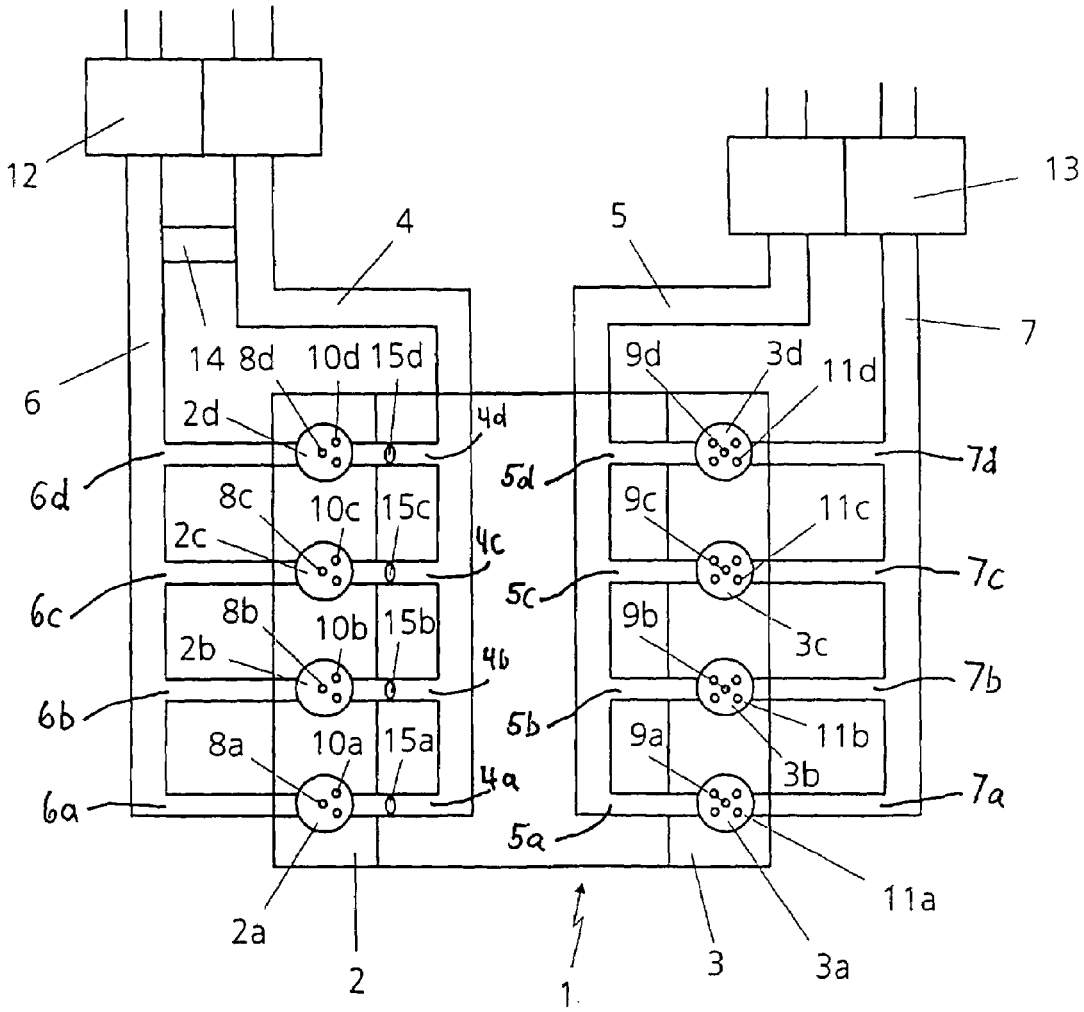
12
13
4
5
7
14
8d
10d
15d
9d
3d
11d
6
2d
4d
7d
6d
5d
8c
10c
15c
9c
11c
2c
4c
7c
6c
5c
8b
10b
15b
9b
3c
2b
4b
7b
6b
5b
8a
10a
15a
9a
11b
3b
4a
7a
6a
5a
11a
2a
2
1
3
3a

INTERNAL COMBUSTION ENGINE

This is a continuation-in-part application of international application PCT/EP02/14453 filed Dec. 18, 2002 and claiming the priority of German application 102 04 482.1 filed Feb. 5, 2002.

BACKGROUND OF THE INVENTION

The invention relates to an internal combustion engine having a plurality of cylinders, at least some of which can be deactivated during operation of the engine.

Internal combustion engines of the generic type are known from DE 196 11 363 C1 or DE 198 12 090 C2. Deactivating some of the cylinders can save fuel in the partial load range of the internal combustion engine.

The object of the present invention is to provide an internal combustion engine with deactivatable cylinders in such a way that even greater advantages can be achieved during operation of such an engine than in present engines with deactivatable cylinders.

SUMMARY OF THE INVENTION

In an internal combustion engine having a plurality of cylinders, some of which can be deactivated during operation of the engine, the cylinders which can be deactivated during operation are configured for high load engine operating conditions, and the remaining cylinders are configured for low load engine operating conditions.

As a result of the fact that the cylinders which can be deactivated during operation are configured for high-load engine operation, the engine can be operated in low load operating situations when only a relatively low power output is needed with only the remaining cylinders, which are configured for low load engine operation. The cylinders which have been deactivated can be immediately reactivated when a full load or a higher load is needed, in order, in this way, to be able to rapidly satisfy the desired load. During operation at relatively high loads, it is under certain circumstances also possible to provide for the cylinders which are configured for low load settings to be powered down.

Due to the configuration of the remaining cylinders for low load engine operation, the cylinders can be equipped with all the systems which reduce the amount of pollutants in the exhaust gases even if these systems have a partially power-reducing effect. In the case of the cylinders which are configured for high load engine operation, it is possible to dispense with such measures, permitting an even higher power output of the internal combustion engine and bringing about lower fuel consumption and lower emission of pollutants, specifically by deactivating these cylinders during low load engine operation.

In one advantageous embodiment of the invention, the cylinders which are configured for high load operation have a lower compression ratio than the cylinders which are configured for low load engine operation. Such a higher compression ratio of those cylinders which are configured for low load operation can lead to low emissions of hydrocarbons and carbon monoxide, in particular in the cold starting mode, whereas the low compression of the cylinders which are configured for high load operation ensures that the nitrogen oxide emissions are reduced when the internal combustion engine is operationally warm so that the concentration of pollutant under all operating conditions can be reduced while the available power or torque is simultaneously increased.

An increase in the power of the cylinders which are configured for high load operation can also be achieved by providing the cylinders which are configured for high load operation with injection nozzles which have a higher fuel injection rate than the injection nozzles of the cylinders which are configured for low load operation of the engine.

One possible way of dividing the cylinders which are configured for high load operation and the cylinders for low load operation based on an engine with two rows of cylinders is to configure one row of cylinders for high load operation and the other row of cylinders for low load operation. In particular, if costly measures for reducing the emissions of exhaust gas are provided for the cylinders which are configured for low load operation, and such measures are to be dispensed with for the cylinders which are configured for high load operation, this can be implemented very advantageously, and with corresponding cost savings, in such engines with two rows of cylinders which are structurally independent of one another.

The invention will become more readily apparent from the from the following description of an exemplary embodiment thereof described below with reference to the accompanying drawing.

BRIEF DESCRIPTION OF THE DRAWINGS

The single FIGURE is a schematic representation of an internal combustion engine according to the invention.

DESCRIPTION OF A PARTICULAR EMBODIMENT

As shown in the Figure, an internal combustion engine 1 has, in a manner which is known per se, two rows 2 and 3 of cylinders which are arranged in a V shape. In each of the two rows 2 and 3 of cylinders there are four cylinders 2*a*, 2*b*, 2*c*, 2*d* and 3*a*, 3*b*, 3*c*, 3*d*, respectively. Of course, any other number of cylinders in the individual rows 2 and 3 of cylinders would be conceivable, as would be any other number of rows of cylinders.

Intake lines 4 and 5 lead to the two rows 2 and 3 of cylinders and supply intake air, via inlet ducts 4*a*, 4*b*, 4*c*, 4*d* and 5*a*, 5*b*, 5*c* 5*d*, respectively, connected thereto, to the respective cylinders 2*a*, 2*b*, 2*c*, 2*d* and 3*a*, 3*b*, 3*c*, 3*d*. The exhaust gas which is generated in the cylinders 2*a*, 2*b*, 2*c*, 2*d* and 3*a*, 3*b*, 3*c*, 3*d* during combustion is emitted through exhaust gas lines 6 and 7, which are connected to the cylinders 2*a*, 2*b*, 2*c*, 2*d* and 3*a*, 3*b*, 3*c*, 3*d*, respectively, via outlet ducts 6*a*, 6*b*, 6*c*, 6*d* and 7*a*, 7*b*, 7*c*, 7*d*, respectively.

The cylinders 3*a*, 3*b*, 3*c*, 3*d* of the row 3 of cylinders are cylinders which can be deactivated while the internal combustion engine 1 is operating and which are configured for high load engine operation. In contrast, the cylinders 2*a*, 2*b*, 2*c*, 2*d* of the row 2 of cylinders are configured for low load engine operation. However, it is also possible for the cylinders 2*a*, 2*b*, 2*c* and 2*d* to be deactivated under certain circumstances, for example during operation of the engine under high, but not maximum, load requirements. In other words, the cylinders 2*a*, 2*b*, 2*c* and 2*d* are configured or optimized for a low fuel consumption and a low emission of pollutants, that is to say optimized with respect to exhaust gas, while the cylinders 3*a*, 3*b*, 3*c* and 3*d* which can be deactivated are configured for a high power output or a high torque, that is to say they are optimized for high load operation.

In order to configure the cylinders 3*a*, 3*b*, 3*c* and 3*d* for relatively high load operation, these cylinders may have, for example, a lower compression ratio than the cylinders 2*a*, 2*b*, 2*c* and 2*d*. Such a lower compression ratio ϵ, which can be brought about, for example, by using other pistons or connecting rods, results in a reduction of nitrogen oxide emissions of the internal combustion engine 1 when it is warm, whereas the higher compression ratio ϵ of the cylinders 2*a*, 2*b*, 2*c* and 2*d* which are configured for low load engine operation, provides for reduced emissions of hydrocarbons and carbon monoxide. Such emissions can lead to problems in particular in the cold start operating mode. Furthermore, because of the lower peak pressures which result from the lower compression ratio ϵ, higher loading of the cylinders 3*a*, 3*b*, 3*c* and 3*d* is also possible.

Injection nozzles 8*a*, 8*b*, 8*c* and 8*d* are arranged in the inlet ducts 4*a*, 4*b*, 4*c* and 4*d* of the cylinders 2*a*, 2*b*, 2*c* and 2*d*, said injection nozzles 8*a*, 8*b*, 8*c* and 8*d* having a lower fuel throughput rate than injection nozzles 9*a*, 9*b*, 9*c* and 9*d* which are arranged in the inlet ducts 5*a*, 5*b*, 5*c*, 5*d* of the cylinders 3*a*, 3*b*, 3*c* and 3*d*. As a result, a larger fuel flow rate can be fed to the cylinders 3*a*, 3*b*, 3*c* and 3*d* than to the cylinders 2*a*, 2*b*, 2*c* and 2*d*, as a result of which said cylinders can generate a higher torque. This higher fuel throughput rate of the injection nozzles 9*a*, 9*b*, 9*c* and 9*d* may be brought about, for example, by larger nozzle openings or different injectors.

Furthermore, the cylinders 2*a*, 2*b*, 2*c* and 2*d* in the present exemplary embodiment have a lower number of charge-changing valves 10*a*, 10*b*, 10*c* and 10*d*, specifically two each, than the cylinders 3*a*, 3*b*, 3*c* and 3*d*, which in the present case are each provided with four charge-changing valves 11*a*, 11*b*, 11*c* and 11*d*. This also contributes to the cylinders 3*a*, 3*b*, 3*c* and 3*d* generating higher power in comparison with the cylinders 2*a*, 2*b*, 2*c* and 2*d*.

In a manner known per se, charge air is supplied both to the cylinders 2*a*, 2*b*, 2*c* and 2*d*, by an exhaust gas turbocharger 12, and to the cylinders 3*a*, 3*b*, 3*c* and 3*d*, by an additional exhaust gas turbocharger 13. In order to be able to increase the power output of the cylinders 3*a*, 3*b*, 3*c* and 3*d* even further, the exhaust gas turbocharger 13 has a higher air throughput rate than the exhaust gas turbocharger 12 of the cylinders 2*a*, 2*b*, 2*c* and 2*d* which are configured for low load operation. This leads at high rotational speeds to relatively high power levels of the internal combustion engine 1 of the higher power of the cylinders 3*a*, 3*b*, 3*c* and 3*d*, whereas a relatively high torque can be generated by the cylinders 2*a*, 2*b*, 2*c* and 2*d* even at low rotation speeds owing to the lower air throughput rate of the exhaust gas turbocharger 12. In addition, the exhaust gas turbocharger 13 could also be equipped with a so-called waste gate, which is known per se, and under certain circumstances with an adjustable turbine geometry.

In order to keep the emission of pollutants of the internal combustion engine 1 as low as possible, the cylinders 2*a*, 2*b*, 2*c* and 2*d* are equipped with an exhaust gas recirculation device 14 which can operate in a manner known per se. If appropriate, an exhaust gas recirculation cooler can also be provided for the exhaust gas recirculation device 14, but is not illustrated.

Furthermore, air inlet control devices 15*a*, 15*b*, 15*c* and 15*d* which are also known per se, for controlling air flow to the cylinders, for example in the form of valves or the like, are provided in the inlet ducts 4*a*, 4*b*, 4*c* and 4*d*. This measure also results in a reduction of the emissions of the cylinders 2*a*, 2*b*, 2*c* and 2*d*, but such a measure is not needed for the cylinders 3*a*, 3*b*, 3*c* and 3*d*, so that it can be eliminated for these cylinders like the exhaust gas recirculation device 14 described above.

As a result of this elimination of various measures which are used for post-treatment of the exhaust gas or conditioning of the mixture at the cylinders 3*a*, 3*b*, 3*c* and 3*d* which are configured for high load engine operation, a considerable potential for reducing the costs of the internal combustion engine 1 is created. For example, in this context exhaust gas treatment systems which are configured differently in the case of the cylinders 2*a*, 2*b*, 2*c* and 2*d* and the cylinders 3*a*, 3*b*, 3*c* and 3*d* can also be used.

The internal combustion engine 1 can be either a diesel engine or a spark ignition engine. An electronic control device (not illustrated) ensures that the respective cylinders are activated and deactivated smoothly. If the heat management of the two groups of cylinders 2*a*, 2*b*, 2*c*, 2*d* and 3*a*, 3*b*, 3*c*, 3*d*, respectively, is correspondingly configured, faster heating of the internal combustion engine 1 can also be achieved.

Although the illustrated form of the internal combustion engine 1 with a V design, in particular as a result of the different application of individual components for reducing pollutants, is particularly suitable, it would also be possible for an internal combustion engine 1 with an inline cylinder arrangement (not illustrated) to configure individual cylinders for high load operation, and other cylinders for low load operation.

Furthermore, it would also be possible for the number of cylinders 3*a*, 3*b*, 3*c*, 3*d* which are configured for high load operation and which can be deactivated during operation to differ from the number of cylinders 2*a*, 2*b*, 2*c* and 2*d* which are configured for low load operation. This specifically may depend on how large the increase in power as a result of the cylinders 3*a*, 3*b*, 3*c* and 3*d* which are configured for high load operation is to be, or which exhaust gas limiting values are to be complied with.

What is claimed is:

1. An internal combustion engine having a plurality of cylinders (2*a*, 2*b*. 2*c*, 2*d*, 3*a*, 3*b*, 3*c*, 3*d*) with some of said cylinders (3*a*, 3*b*, 3*c*, 3*d*) being deactivatable during low load operation of said engine, said deactivatable cylinders (3*a*, 3*b*, 3*c*, 3*d*) being configured specifically for high load engine operation and having a lower compression ratio (ϵ) than the rest of the cylinders (2*a*, 2*b*, 2*c*, 2*d*), which are configured specifically for low load engine operation, a first turbocharger (12) connected to the cylinders (2*a*–2*d*) configured for low load engine operation for supplying charge air to the cylinders configured for low load engine operation and a second turbo-charger (13) connected to the cylinders (3*a*–3*d*) configured for high load engine operation for supplying charge air to the cylinders configured for high load engine operation, said second turbocharger (13) having a higher air throughput rate than said first turbocharger (12) for supplying more air to the cylinders which are configured for high load operation and have the lower compression ratio.

2. The internal combustion engine as claimed in claim 1, wherein the cylinders (3*a*, 3*b*, 3*c*, 3*d*) which are configured for high load engine operation are provided with injection nozzles (9*a*, 9*b*, 9*c*, 9*d*) which have a higher fuel throughput rate than the injection nozzles (8*a*, 8*b*, 8*c*, 8*d*) of the cylinders (2*a*, 2*b*, 2*c*, 2*d*) which are configured for low load operation.

3. The internal combustion engine as claimed in claim 1, wherein the cylinders (2*a*, 2*b*, 2*c*, 2*d*) which are configured for low load operation are provided with an exhaust gas recirculation device (14).

4. The internal combustion engine as claimed in claim 1, wherein the cylinders (3*a*, 3*b*, 3*c*, 3*d*) which are configured for high load operation have a higher number of load-changing valves (11*a*, 11*b*, 11*c*, 11*d*) than the cylinders (2*a*, 2*b*, 2*c*, 2*d*) which are configured for low load operation.

5. The internal combustion engine as claimed in claim 1, wherein the cylinders (2*a*, 2*b*, 2*c*, 2*d*) which are configured for low load operation are provided with air inlet control devices (15*a*, 15*b*, 15*c*, 15*d*).

6. The internal combustion engine as claimed in claim 1, wherein two rows (2, 3) of cylinders are provided, the cylinders (3*a*, 3*b*, 3*c*, 3*d*) which are configured for high load operation being arranged in one row (3) of cylinders, and the cylinders (2*a*, 2*b*, 2*c*, 2*d*) which are configured for low load operation being arranged in the other row (2) of cylinders.

7. The internal combustion engine as claimed in claim 1, wherein the number of cylinders (3*a*, 3*b*, 3*c*, 3*d*) which are configured specifically for high load operation corresponds to the number of cylinders (2*a*, 2*b*, 2*c*, 2*d*) which are configured specifically for low load operation.

* * * * *